US005664286A

United States Patent [19]

Sorimachi

[11] Patent Number: 5,664,286

[45] Date of Patent: Sep. 9, 1997

[54] HINGE MECHANISM FOR SUPPORTING THE SEAT OR THE SEAT LID OF A TOILET BOWL

[75] Inventor: Akira Sorimachi, Kanagawa, Japan

[73] Assignee: Katoh Electrical Machinery Co., Ltd., Kanagawa, Japan

[21] Appl. No.: 515,456

[22] Filed: Aug. 15, 1995

[30] Foreign Application Priority Data

Aug. 27, 1994 [JP] Japan ..... 6-011711

[51] Int. Cl.[6] ..... A47K 13/10

[52] U.S. Cl. ..... 16/54; 16/82; 4/246.2; 188/307; 188/295; 188/284

[58] Field of Search ..... 16/54, 82, 319, 16/337; 4/248, 246.2; 188/307, 308, 318, 295, 296, 284, 293

[56] References Cited

U.S. PATENT DOCUMENTS

| | | | |
|---|---|---|---|
| 2,456,537 | 12/1948 | Seaman et al. | 16/54 |
| 2,490,258 | 12/1949 | Diebel | 16/54 |
| 4,653,141 | 3/1987 | Converse | 16/82 |
| 4,825,503 | 5/1989 | Shiramasa et al. | 16/82 |
| 5,193,228 | 3/1993 | Murasawa et al. | 4/236 |
| 5,255,396 | 10/1993 | Miyahara et al. | 4/248 |
| 5,267,356 | 12/1993 | Gideon et al. | 4/248 |
| 5,390,770 | 2/1995 | Miyahara et al. | 188/307 |
| 5,400,878 | 3/1995 | D'Anna et al. | 188/293 |
| 5,419,013 | 5/1995 | Hsiao | 16/319 |
| 5,449,054 | 9/1995 | Wiese et al. | 16/82 |

*Primary Examiner*—Maurina T. Rachuba
*Assistant Examiner*—Christopher Kirkman
*Attorney, Agent, or Firm*—Notaro & Michalos P.C.

[57] ABSTRACT

A hinge mechanism has a damping mechanism and is capable of removing or reducing to the least extent the damping action of the damping mechanism when opening the seat or the seat lid of a toilet bowl, of securely holding the seat or the seat lid at the open position, of making the damping action effective so that the seat or the seat lid can turn gradually to its closed position and of avoiding the breakage of the damping mechanism due to jerky loading when the seat or the seat lid is turned with a jerk. The hinge mechanism comprises a case, a hinge shaft supporting the seat or the seat lid and supported in the case for rotation and axial movement, a fluidic damping mechanism formed between the case and the hinge shaft, and a resilient means biasing the hinge shaft in one direction.

5 Claims, 7 Drawing Sheets

HINGE MECHANISM FOR SUPPORTING THE SEAT OR THE SEAT LID OF A TOILET BOWL

1. FIELD OF THE INVENTION

The present invention relates to a hinge mechanism capable of stably holding the seat or the seat lid of a toilet bowl in an open position and of damping the turning motion of the seat or the seat lid so that the seat or the seat lid may not slam down.

2. DESCRIPTION OF THE RELATED ART

A known hinge mechanism for such a purpose has a hinge shaft supported for rotation on a spring case attached to the upper surface of the back portion of a toilet bowl and connected to the seat or the seat lid of a toilet bowl so as to rotate in connection with opening and closing of the seat or the seat lid, and a torsion spring wound around the hinge shaft in the spring case so as to rotatively bias the hinge shaft in a direction in which the seat or the seat lid is turned for opening.

This known hinge mechanism employing the torsion spring needs the adjustment of the torque of the torsion spring because different torsion springs exert different torques on the hinge shaft and the torque of the torsion spring varies linearly while the torque of the seat or the seat lid varies in a sinusoidal curve when the seat or the seat lid is turned. If the torque of the torsion spring is excessively large, the seat or the seat lid floats slightly over the toilet-bowl, there is the possibility that the seat or the seat lid springs up from a position near a fully open position. If the torque of the torsion spring is excessively small, the seat or the seat lid cannot be securely held at the fully open position.

Another known hinge mechanism utilizes the damping action of a viscous fluid sealed in a narrow space formed between a case and a hinge shaft held in the case. However, the seat or the seat lid supported by this hinge mechanism needs to be opened against the damping action of the viscous fluid and cannot be lightly opened because the damping action of the viscous fluid is effective in both opening and closing the seat or the seat lid. A hinge mechanism proposed to solve such a problem employs a fluidic damping mechanism provided with a valve and disposed between a case and a hinge shaft supported in the case. In this hinge mechanism, there is the possibility that the fluidic damping mechanism is damaged easily by jerky loading when the seat or the seat lid is turned with a jerk or the seat is loaded immediately before the same reaches the seating position.

3. OBJECT OF THE INVENTION

It is an object of the present invention to provide a hinge mechanism of a simple construction employing a fluidic damping mechanism including valves, capable of removing or reducing to the least extent the fluidic damping action of the fluidic damping mechanism when opening the seat or the seat lid of a toilet bowl, of securely holding the seat or the seat lid at the open position, of making the fluidic action of the fluidic damping mechanism effective when closing the seat or the seat lid so that the seat or the seat lid can be turned gradually to its closed position, and of avoiding the breakage of the fluidic damping mechanism due to jerky loading when the seat or the seat lid is turned with a jerk.

With the foregoing object in view, a hinge mechanism in a first aspect of the present invention for supporting the seat or the seat lid of a toilet bowl comprises a case mounted on the toilet bowl, a hinge shaft supported for rotation and axial sliding movement in the case and having one end fixedly connected to the base end of the seat or the seat lid of the toilet bowl, a fluidic damping mechanism provided with valves and interposed between the case and the hinge shaft, and an resilient means for axially biasing the hinge shaft in one direction.

In a second aspect of the present invention, the case of the hinge mechanism in the first aspect of the present invention may be provided with a connecting means for fixedly connecting the case to a support means fixedly mounted on the toilet bowl.

In a third aspect of the invention, the fluidic damping mechanism of the hinge mechanism in the first aspect of the present invention may be comprised of valves formed on the hinge shaft and contained in a fluid chamber defined within the case, fluid filled in the fluid chamber, and stopping ridges projecting radially inward from the inner circumference of the case to stop the turning of each of the valves at a predetermined angular position.

In a fourth aspect of the present invention, in the hinge mechanism in the first aspect of the present invention for supporting the seat or the seat lid of a toilet bowl, the hinge shaft comprises a first shaft member having a flange fitted in the case, and a mounting part projecting from one end of the flange and connected to the seat or the seat lid of the toilet bowl, and a second shaft member fixedly and coaxially joined to the other end of the flange of the first shaft member provided with valves, and also in a fifth aspect of the invention, the valves of the present invention comprise: vanes radially projecting from the hinge shaft, received in the fluid chamber formed in the case, provided with radial grooves radially extending from the peripheries toward the axis of the hinge shaft, respectively, slots each formed through one of the walls defining the radial groove, and recesses each formed in the edge of the other of the walls defining the radial groove; valve elements fitted in the grooves to open and close the slots, respectively; and the partition wall of the case provided with circular grooves in the side surface thereof in sliding contact with the end surfaces of the vanes, and the resilient means for axially biasing the hinge shaft in one direction is a spring washer.

In the hinge mechanism in the first or the second aspect of the present invention, the fluidic damping mechanism provided with the valves has a unidirectional damping function that enables the seat or the seat lid to be turned lightly for opening, to turn gradually and smoothly for closing, and prevents the seat or seat lid from slamming down and from floating. When the fluidic damping mechanism is overloaded by turning the seat or the seat lid by hand with a jerk or by some cause, the hinge shaft is moved axially by the fluid against the resilience of the resilient means, so that the volume of the fluid chamber is increased to enable the fluid to flow smoothly and hence the fluidic damping mechanism is not broken.

The hinge mechanism in the second aspect of the present invention can be easily attached to and removed from the support means.

In the hinge mechanism in the third aspect of the present invention, the valve is opened and closed by the vane of a simple construction that turns together with the hinge shaft.

In the hinge mechanism in the fourth aspect of the present invention, the first shaft member and the second shaft member may be formed of different materials, respectively, and the fluid chamber can be properly filled with the fluid because, when assembling the hinge mechanism, the first shaft member is inserted in the case, the fluid is poured into the fluid chamber, and then the second shaft member is combined with the first shaft member so that the excess fluid poured into the fluid chamber flows through the joint of the first shaft member and the second shaft member out of the case.

In the hinge mechanism in the fifth aspect of the present invention, the valve elements are caused to swing by the fluid pushed by the vanes to open or close the slots so that passages for the fluid are opened or closed according to the turning direction of the hinge shaft, which realizes the unidirectional damping function.

In the hinge mechanism in the sixth aspect of the present invention, the resilient means has a small thickness and, therefore, the axial length of the case may be comparatively small, which enables the hinge mechanism to be formed in a compact construction at a lower manufacturing cost.

4. BRIEF DESCRIPTION OF THE DRAWINGS

5. DESCRIPTION OF THE PREFERRED EMBODIMENTS

Figure 1:
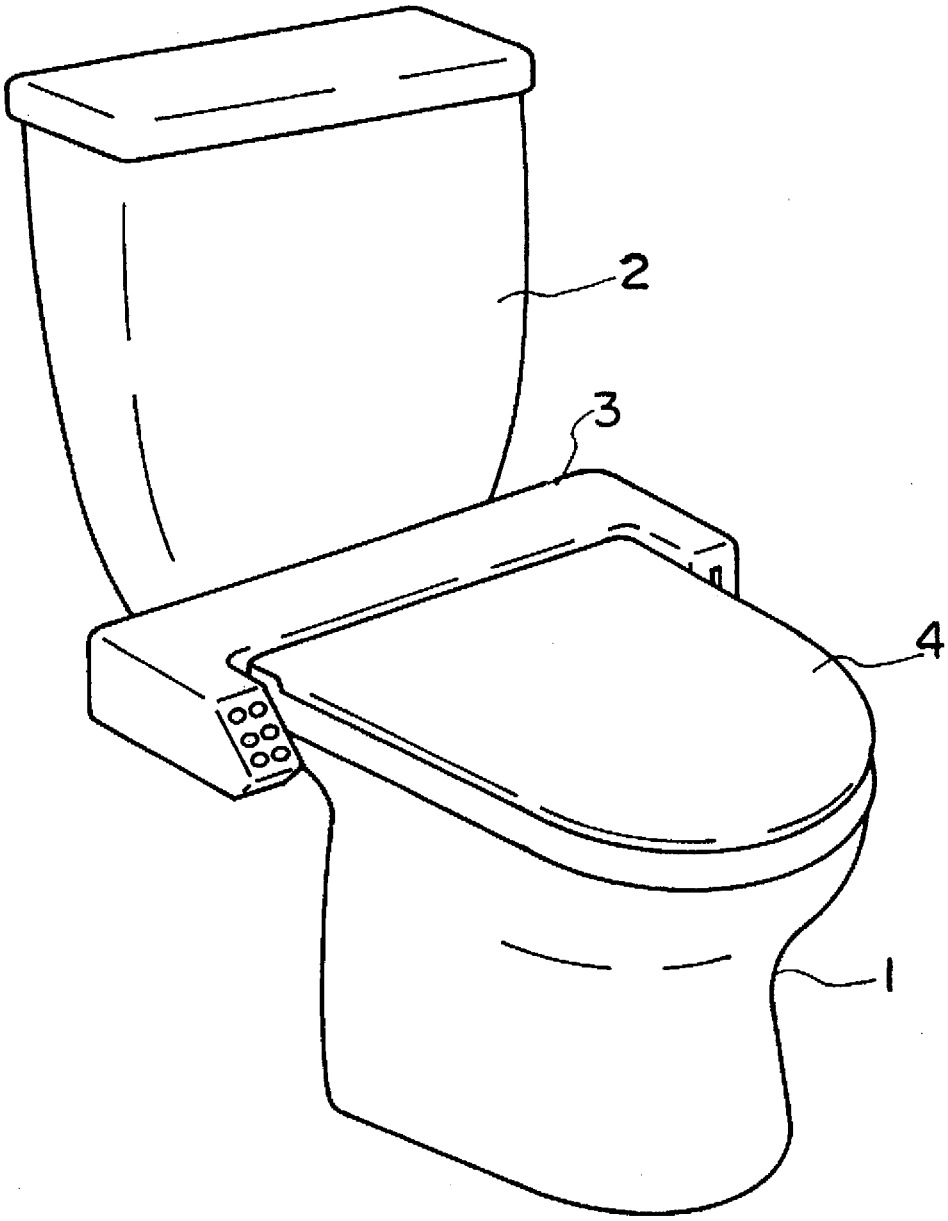
FIG. 1 is a perspective view of a toilet bowl incorporating a preferred embodiment of the present invention.
Figure 2:
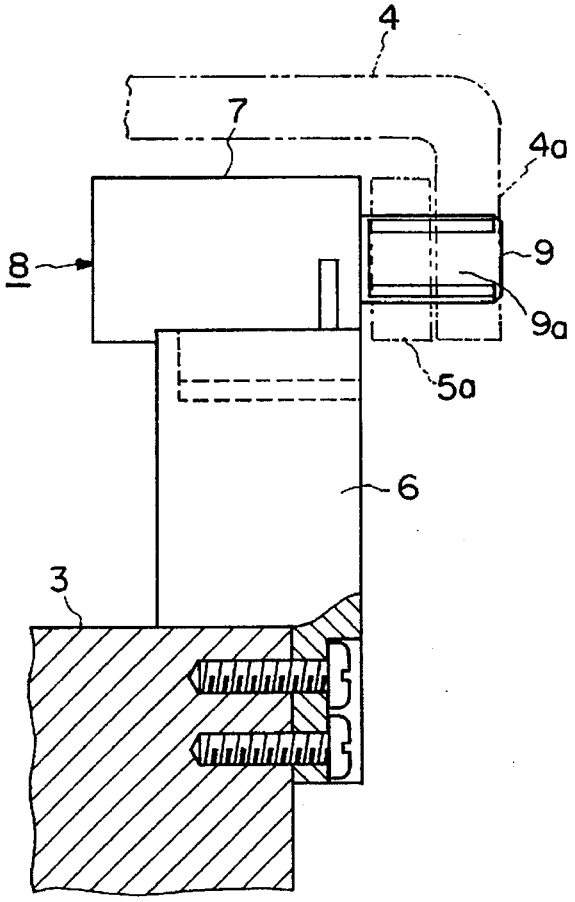
FIG. 2 is a partial sectional side view for assistance in explaining a structure for mounting a hinge mechanism in accordance with the present invention on the toilet bowl.
Figure 3:
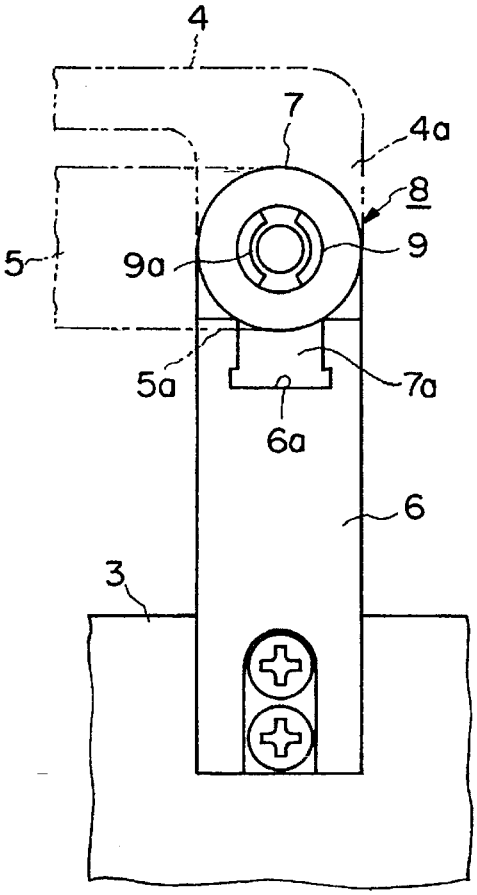
FIG. 3 is a partial sectional front view for assistance in explaining the structure for mounting a hinge mechanism in accordance with the present invention on the toilet bowl.

A hinge mechanism in a preferred embodiment according to the present invention will be described hereinafter with reference to the accompanying drawings. In FIG. 1, indicated at 1 is a toilet bowl and at 2 is a water tank. A control unit 3 is disposed on the back portion of the toilet bowl 1 and in front of the water tank 2. A seat lid 4 and a seat 5 are pivotally supported by a pair of hinge mechanisms 8, not shown in FIG. 1, on the opposite transverse ends of the control unit 3. As best shown in FIGS. 2 and 3, in which only one of the pair of hinge mechanisms 8, supporting the seat lid 4 is shown, a bracket 6 provided with a groove 6*a* at its upper end is attached to the control unit 3 and the toilet bowl 1. The leg 7*a* of a case 7 included in the hinge mechanism 8 is fitted in the groove 6*a*. The case 7 may be directly attached to the toilet bowl 1.

The leg 4*a* of the seat lid 4 is fixed to the mounting part 9*a* of a hinge shaft 9, projecting outside from one end of the case 7, and the leg 5*a* of the seat 5 is supported for turning on the mounting part 9*a* of the hinge shaft 9. The other leg, not shown, of the seat 5 is fixed to the mounting part of the hinge shaft of the other hinge mechanism 8, not shown, and the other leg, not shown, of the seat lid 4 is supported for turning on the hinge shaft of the other hinge mechanism 8. The pair of hinge mechanisms 8 control the respective torques of the seat lid 4 and the seat 5, respectively.

The hinge mechanism 8 for controlling the torque of the seat lid 4 will be described with reference to FIGS. 4 to 8. Since the other hinge mechanism 8 for controlling the torque of the seat 5 is a mirror image of the hinge mechanism 8 for controlling the torque of the seat lid 4, and the construction and functions of the same is identical with those of the former hinge mechanism 8, the description thereof will be omitted.

Referring to FIGS. 4 to 8, the interior of the case 7 having open opposite ends is divided into a fluid chamber 11 and a resilient means member containing chamber 12 by a partition wall 10 provided with a bearing hole 10*a*. The outer end of the fluid chamber 11 is expanded slightly to form a flange receiving part 13. The hinge shaft 9 consists of a first shaft member 15 having the mounting part 9*a* and a flange 15*b* provided with a coupling hole 15*a*, and a second shaft member 16. One end of the second shaft member 16 is fitted together with a sealing member 35 in the coupling hole 15*a* of the first shaft member 15 so as to be coaxial with the first shaft member 15, and the first shaft member 15 and the second shaft member 16 are axially fastened together with a screw 17. The flange 15*b* of the first shaft member 15 is fitted in the case 7, and a sealing member 18, such as an O ring, is fitted in an annular groove formed in the outer circumference of the flange 15*b* to seal the clearance between the flange 15*b* and the inner circumference of the case 7. A sealing member 14, such as an O ring, is fitted in an annular groove formed in the outer circumference of a portion of the second shaft member 16 supported in the bearing hole 10*a* of the partition wall 10. No annular groove is formed in a portion of the bearing hole 10*a* of the partition wall 10 and a portion of the inner circumference of the flange receiving part 13 to facilitate the axial sliding movement of the hinge shaft 9.

A damping mechanism 19 included in the hinge mechanism 8 will be described hereinafter. A pair of valves 20 are formed diametrically opposite to each other and integrally with the second shaft member 16 in the substantially middle portion of the second shaft member 16.

Figure 7:
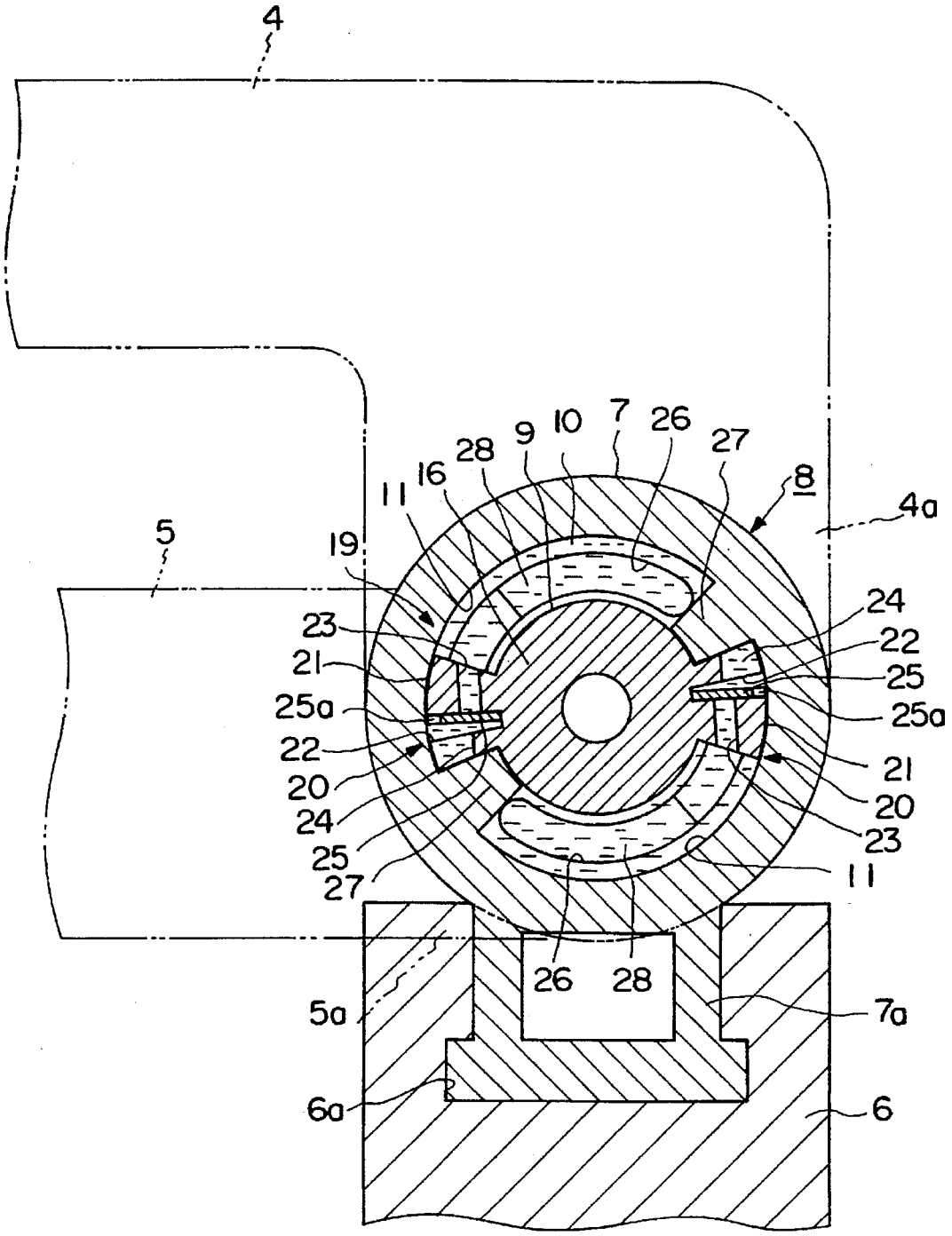
FIG. 7 is a sectional side view for assistance in explaining a damping mechanism included in the hinge mechanism in accordance with the present invention in a state where the seat lid is closed.

As shown in FIG. 7, the pair of valves 20 comprise: a pair of vanes 21 radially projecting from the second shaft member 16 of the hinge shaft 9 at diametrically opposite positions, respectively, each provided with a radial groove 22 radially extending from the peripheries toward the axis of the hinge shaft, a slot 23 formed through one side wall defining the radial groove 22, and a recess 24 formed in the other side wall defining the radial groove 22; valve elements 25 fitted in the grooves to open and close the slot and provided with recesses 25*a*; and the partition wall 10 of the case, provided with circular grooves 26 having the tapered depth. The vanes 21 are in contact with the inner circumference of the fluid chamber 11, the partition wall 10 and the end surface of the flange 15*b* of the first shaft member 15.

A pair of stopping ridges 27 project radially inward from the inner circumference of the fluid chamber 11 of the case 7 containing the valves 20 so as to be in contact with the outer circumference of the second shaft member 16 to divide the fluid chamber 11 into two sections. The fluid chamber 11 is filled up with a fluid 28, such as silicon oil.

A spring seat 30 is put slidably on an end portion of the second shaft member 16, extending through the bearing hole 10*a* of the partition wall 10 and projecting into the resilient member containing chamber 12, and another spring seat 29 is fastened to the end surface of the same end portion of the second shaft member 16 with a screw 31. A spring washer 32, i.e., a wave washer, is compressed between the spring seats 29 and 30. A compression spring may be used instead of the spring washer 32. An end plate 33 is fitted in the open end of the case 7, a sealing member 34, such as an O ring, is fitted in an annular groove formed in the outer circumference of the end plate 33 and in an annular groove formed in the inner circumference of the case 7 to seal the case and to retain the end plate 33 on the case 7.

Since the leg 4*a* of the seat lid 4 is fixed to the mounting part 9*a* of the hinge shaft 9, the hinge shaft 9 is turned in the case 7 when the seat lid 4 is turned for opening and closing. When the seat lid 4 is turned for opening, the vanes 21 of the valves 20 turns clockwise in the fluid chamber 11 from positions shown in FIG. 7. Consequently, the valve elements 25 are pushed counterclockwise in the grooves 22 by the fluid 28 and are separated from the walls provided with the slots 23, so that the slots 23 are opened and passages are formed through the slots 23, the recesses 25*a* of the valve elements 25 and the recesses 24 formed in the other walls of the vanes 21. Then, the fluid 28 is allowed to flow through the passages and the circular grooves 26 having the tapered depth gradually increasing in the turning direction of the vanes 21. Therefore, the fluid 28 does not exert any damping action on the vanes 21 and hence the seat lid 4 can be turned without any effective resistance until the vanes 21 come into contact with the stopping ridges 27.

Figure 8:
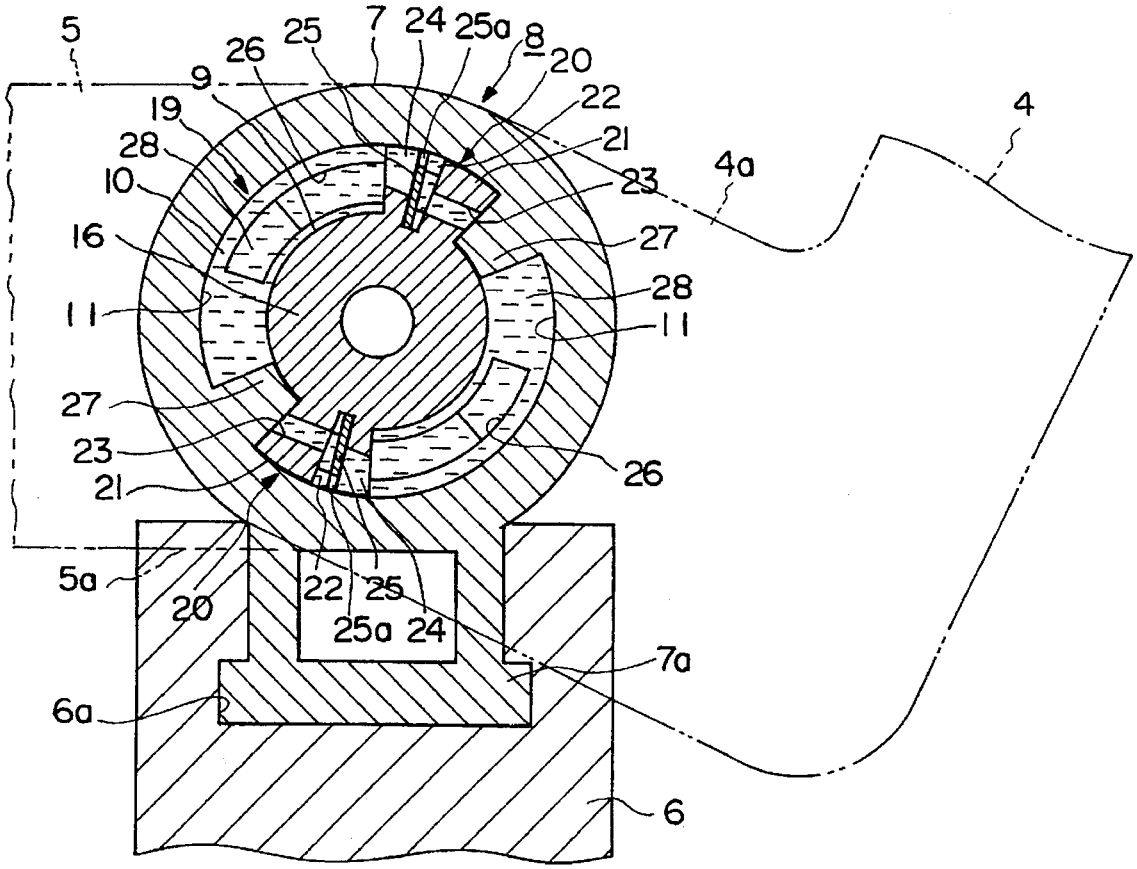
FIG. 8 is a sectional side view for assistance in explaining the damping mechanism in a state where the seat lid is fully open.

In FIG. 8, the seat lid 4 is at an angular position of 110°, i.e., a fully open position. When the seat lid 4 is turned for closing from the fully open position shown in FIG. 8, the vanes 21 of the valves 20 turn counterclockwise in the fluid chamber 11. Consequently, the valve elements 25 are pushed clockwise in the grooves 22 by the fluid 28 and are pressed against the walls provided with the slots 23, so that the slots 23 are closed and the fluid 28 is allowed to flow only through the circular grooves 26 having the tapered depth gradually decreasing in the turning direction of the vanes 21. Therefore, the resistance against the flow of the fluid 28 flowing through the circular grooves 26 increases gradually as the seat lid 4 is turned counterclockwise, increasing the damping effect of the fluid 28, so that the seat lid 4 does not slam down but turns down gradually. Since the damping mechanism 19 is incapable of urging the seat lid 4 in the opening direction, the seat lid 4 is not caused to float on the toilet bowl 1.

Figure 4:
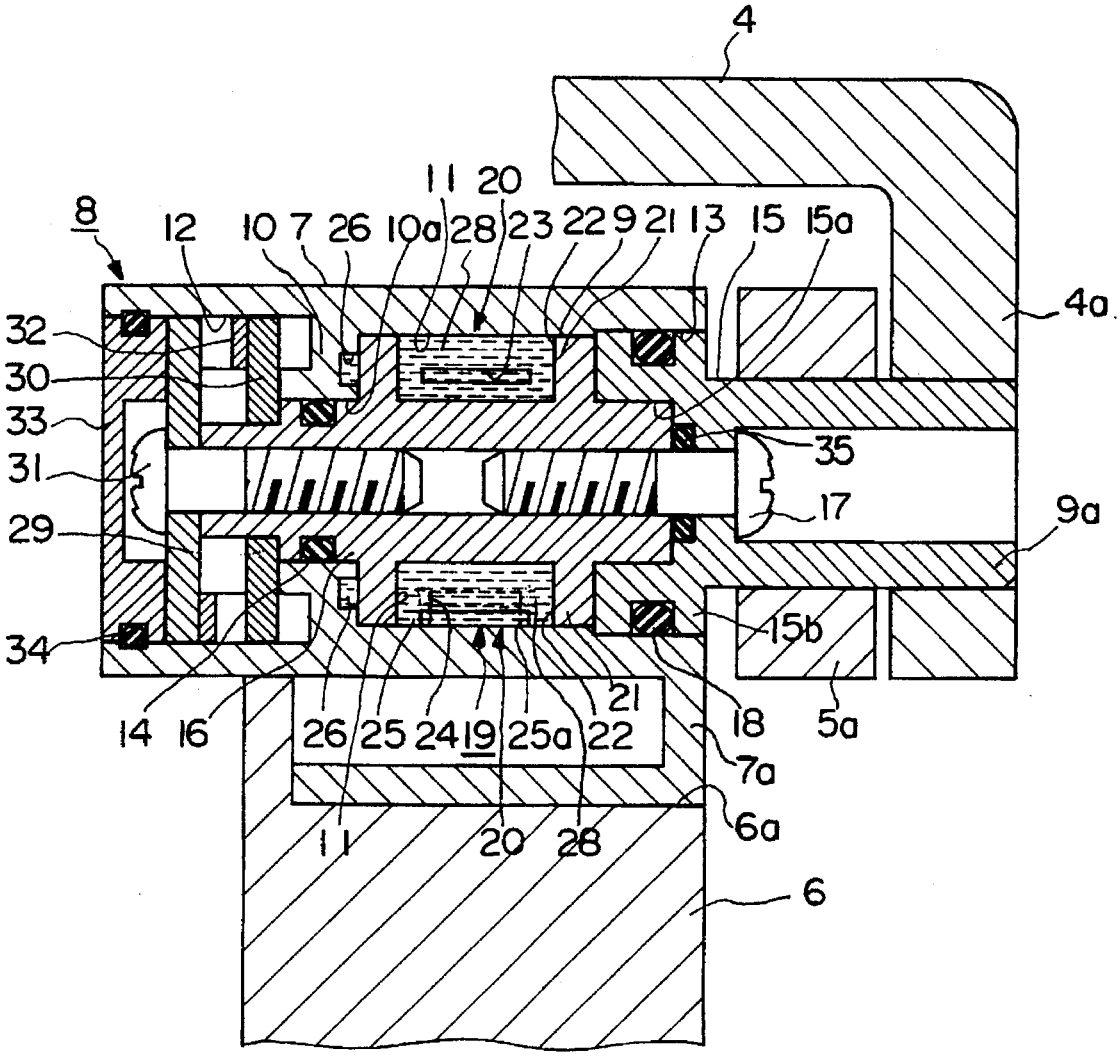
FIG. 4 is a longitudinal sectional view of the hinge mechanism in accordance with the present invention.
Figure 5:
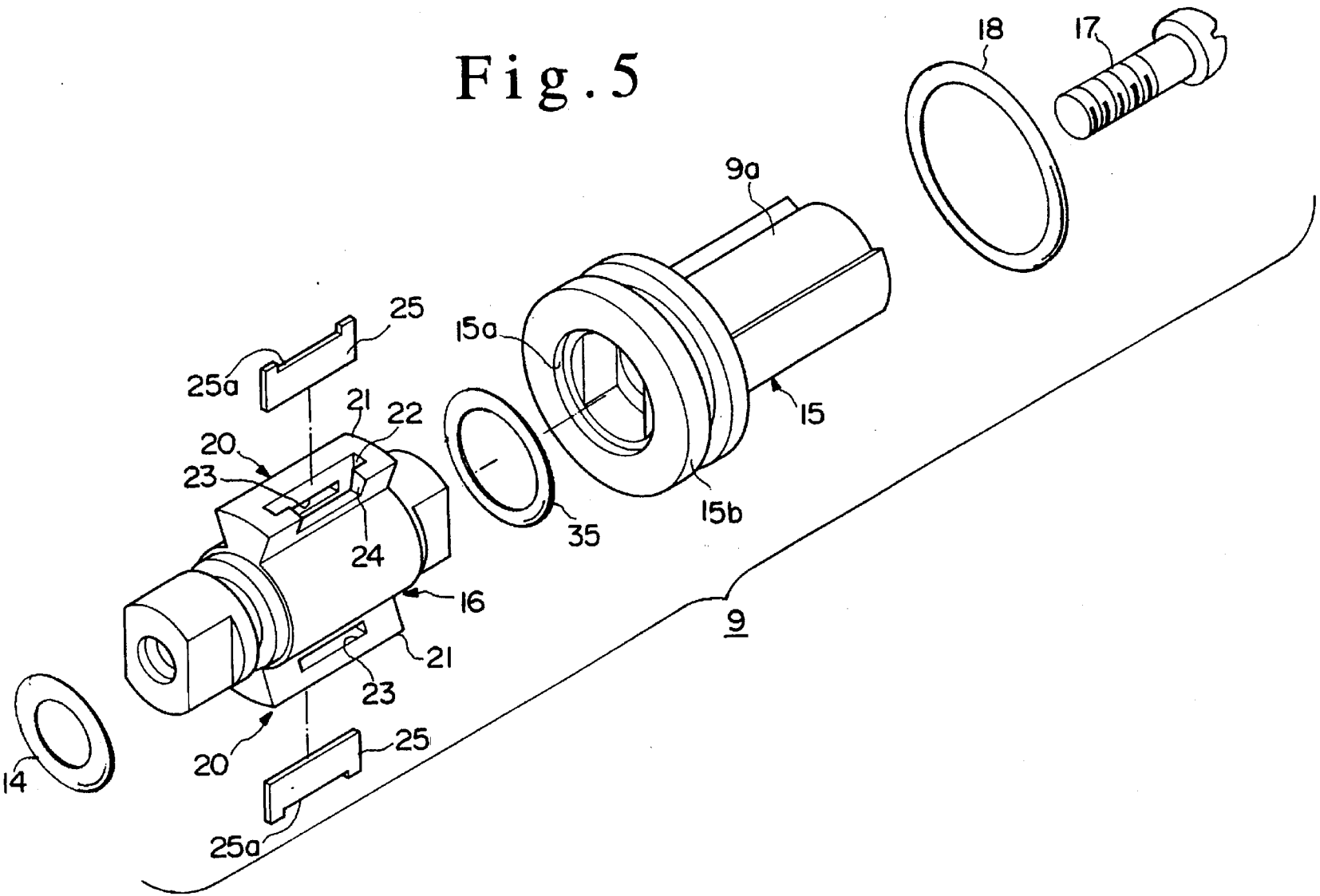
FIG. 5 is an exploded perspective view of a hinge shaft and valves included in the hinge mechanism in accordance with the present invention.
Figure 6:
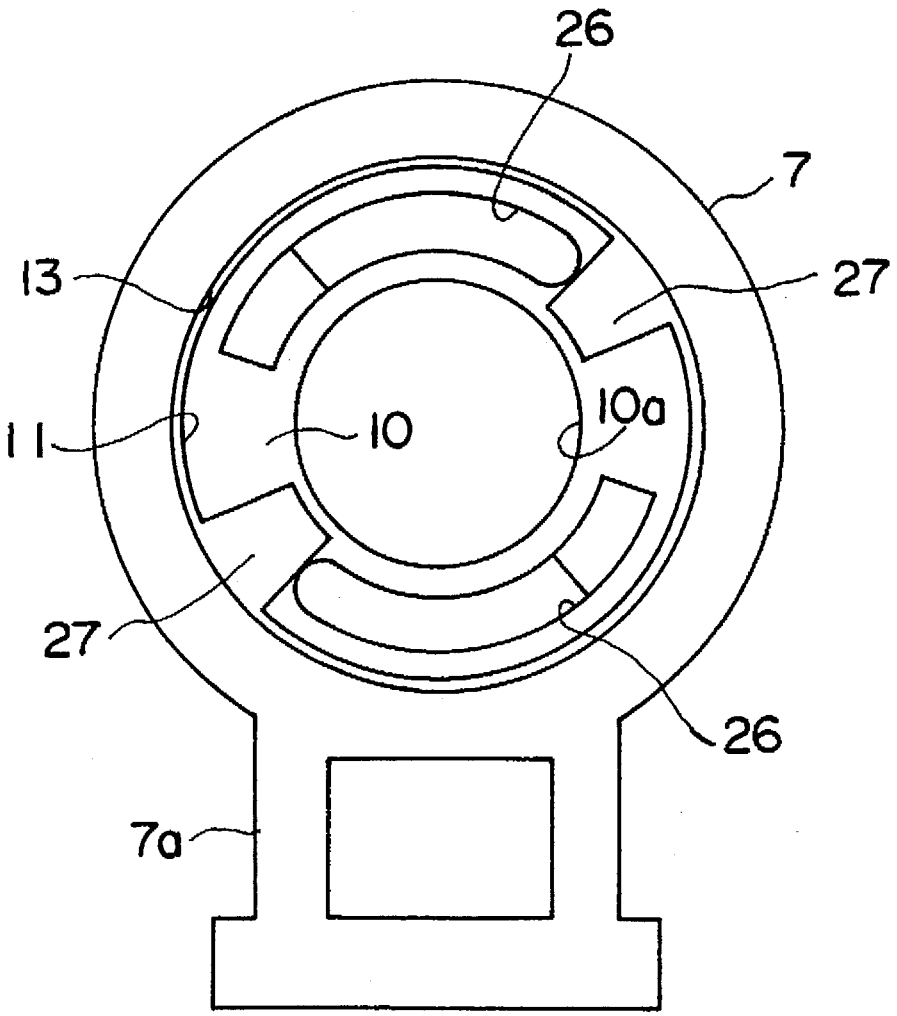
FIG. 6 is a side view of a case included in the hinge mechanism in accordance with the present invention.

When the hinge shaft 9 is overloaded due to some cause, such as a jerky turning action exerted on the seat lid 4, the fluid 28 makes effort to flow through the circular grooves 26 and applies pressure to the hinge shaft 9 to shift the hinge shaft 9 rightward, as viewed in FIG. 4, against the resilience of the spring washer 32. Consequently, the volume of the fluid chamber 11 is increased and the fluid is able to flow through gaps formed between the partition wall 10 and the vanes 21, so that the pressure of the fluid 28 in the fluid chamber decreases to avoid the breakage of the case 7 and the damping mechanism 19. When the overload is removed from the hinge shaft 9, the hinge shaft 9 is shifted leftward to its original position by the resilience of the spring washer 32.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A hinge mechanism for supporting the seat of the seat lid of a toilet bowl, comprising:

a case mounted on the toilet bowl;

a hinge shaft having a longitudinal axis supported for rotation and axial sliding movement in the case and having one end fixedly connected to the base end of the seat or the seat lid of the toilet bowl;

a fluidic damping mechanism provided with valves and interposed between the case and the hinge shaft;

the valves comprising: at least two vanes projecting radially from the hinge shaft and received in a fluid chamber formed within the case, each vane provided with a radial groove radially extending from an end of the vane toward the longitudinal axis of the hinge shaft, each radial groove having at least two side walls; a plurality of slots, each slot formed through one of the at least two side walls of each radial groove; a plurality of recesses, one recess formed adacent an edge of each of the other of the side walls of the radial grooves; a plurality of valve elements, one valve element located in each groove for opening and closing each slot; and a partition wall in the case, the partition wall having a plurality of circular grooves in a side surface of the partition wall, the circular grooves in sliding contact with the ends of the vanes; and a resilient means for axially biasing the hinge shaft in one direction.

2. A hinge mechanism for supporting the seat or the seat lid of a toilet bowl, according to claim 1, wherein the case is provided with a connecting means for fixedly connecting the case to a support means fixedly mounted on the toilet bowl.

3. A hinge mechanism for supporting the seat or the seat lid of a toilet bowl, according to claim 1 wherein the fluidic damping mechanism comprises valves formed on the hinge shaft and contained in a fluid chamber defined within the case, viscous fluid filled in the fluid chamber, and stopping ridges projecting radially inward from the inner circumference of the case to stop the turning of each of the valves at a predetermined angular position.

4. A hinge mechanism for supporting the seat or the seat lid of a toilet bowl, according to claim 1, wherein the hinge shaft comprises a first shaft member having a flange fitted in the case and a mounting part projecting from one end of the flange and connected to the seat or the seat lid of the toilet bowl, and a second shaft member fixedly and coaxially joined to the other end of the flange of the first shaft member and provided with the valves.

5. A hinge mechanism for supporting the seat or the seat lid of a toilet bowl, according to claim 1, wherein the resilient means for axially biasing the hinge shaft in one direction is a spring washer.

* * * * *